United States Patent [19]

Hanson et al.

[11] 3,988,970

[45] Nov. 2, 1976

[54] APPARATUS FOR FORMING FLAT BOTTOM PLASTIC BAGS

[75] Inventors: Violet M. Hanson, Old Bethpage; John E. Finn, Plainview, both of N.Y.

[73] Assignee: Violet M. Hanson, Old Bethpage, N.Y.

[22] Filed: July 31, 1975

[21] Appl. No.: 600,737

Related U.S. Application Data

[62] Division of Ser. No. 472,167, May 22, 1974, Pat. No. 3,924,521.

[52] U.S. Cl. ..... 93/14; 53/386; 93/8 R; 93/84 FF

[51] Int. Cl.[2] ..... B31B 33/00

[58] Field of Search ..... 93/8 R, 33 H, 33 R, 93/35 SB, 35 R, 84 FF, 84 R, 14–31; 53/386, 385, 384

[56] References Cited

UNITED STATES PATENTS

| | | | |
|---|---|---|---|
| 2,281,516 | 4/1942 | Royal | 53/386 |
| 3,083,618 | 4/1963 | Vergobbi | 93/35 SB |
| 3,094,905 | 6/1963 | Haslacher | 93/35 SB |
| 3,568,400 | 3/1971 | Pitts | 53/386 X |
| 3,738,079 | 6/1973 | Rudman et al. | 53/183 X |
| 3,755,984 | 9/1973 | Vanderpool | 53/386 X |
| 3,915,077 | 10/1975 | LaFleur et al. | 93/26 X |

*Primary Examiner*—James F. Coan
*Attorney, Agent, or Firm*—Bauer, Amer & King

[57] ABSTRACT

Flat bottom bags are formed from a supply of substantially endless plastic tubing, gusseted along two sides to form a flat reel. A sleeve of predetermined length is withdrawn from the reel and allowed to hang along a vertical plane between two foraminous plenum chambers which are then moved toward each other to squeeze the length therebetween. Simultaneously a sealing and shearing mechanism forms a transverse seal and cuts the sleeve length from the reel, the gussets being at the same time sealed in the seam. The plenum chambers are then subject to vacuum and are moved apart, causing the sides of the now formed bag to separate opening the same. Upon opening of the bag, a forming mandrel is inserted therein and moved through the length of the bag until it reaches the sealed end. Simultaneously a presser member is moved across the outside surface of the bag folding over the seam, and pressing the gusset portions into flat flaps and in addition forming simultaneously the flat bottom to the bag. The mandrel or the presser plate is provided with heat sealing means sealing the flaps to the sleeve sides.

20 Claims, 19 Drawing Figures

FIG. 3A
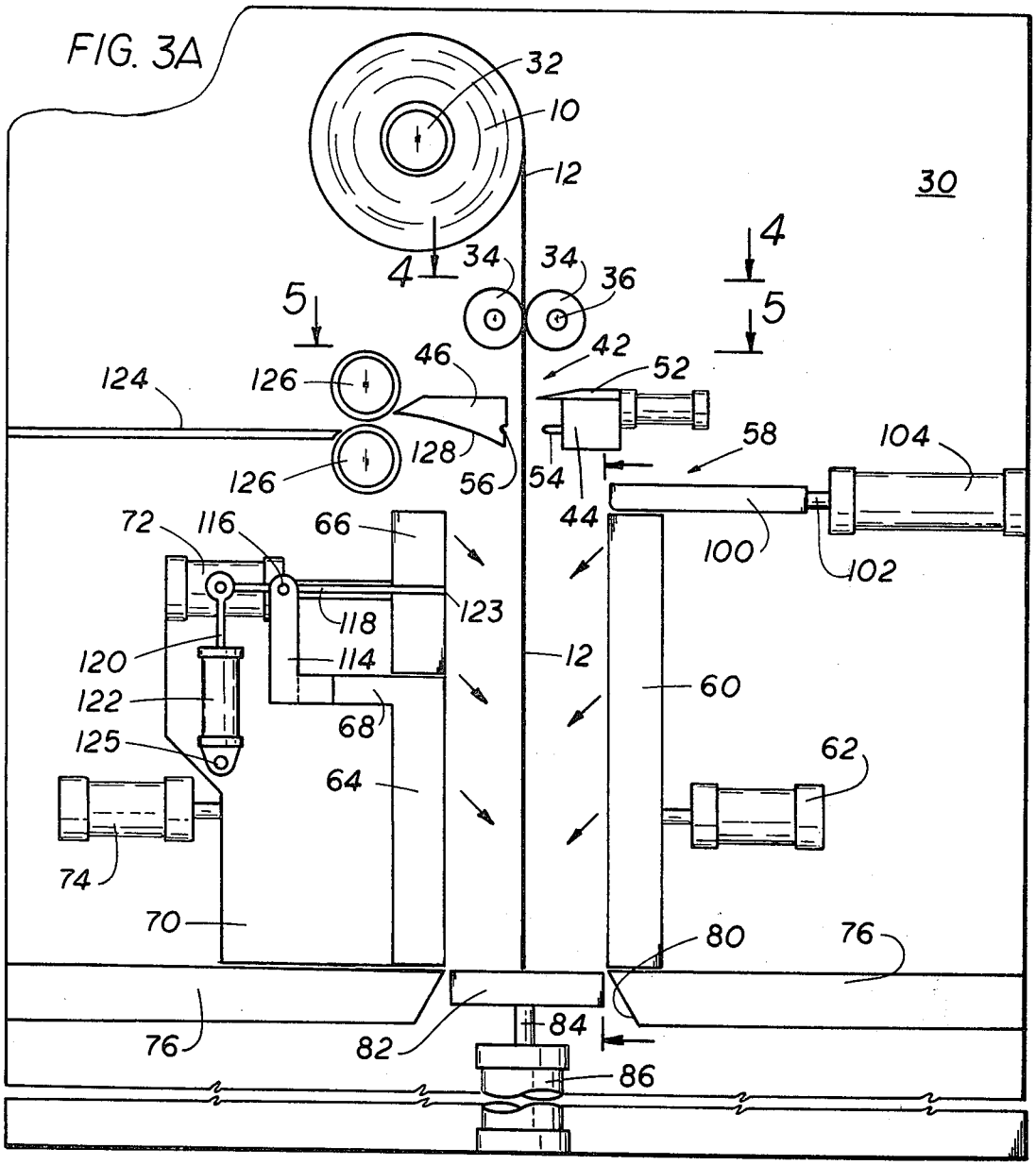
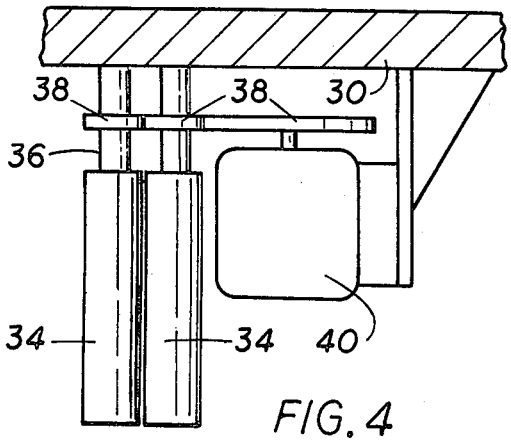
FIG. 4
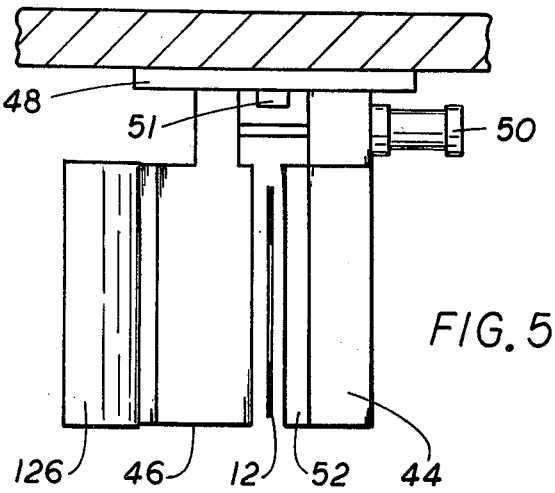
FIG. 5

FIG. 3B
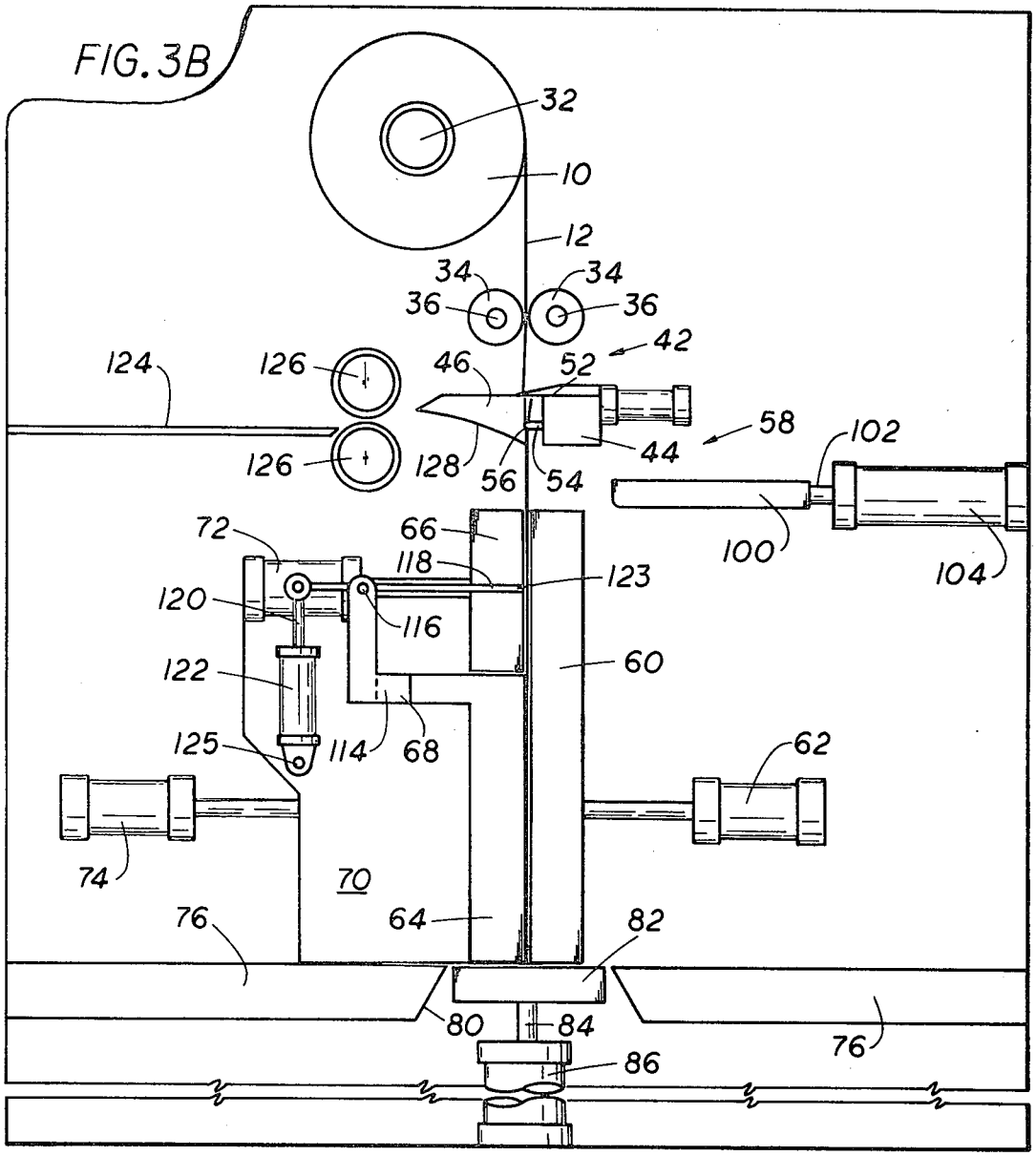
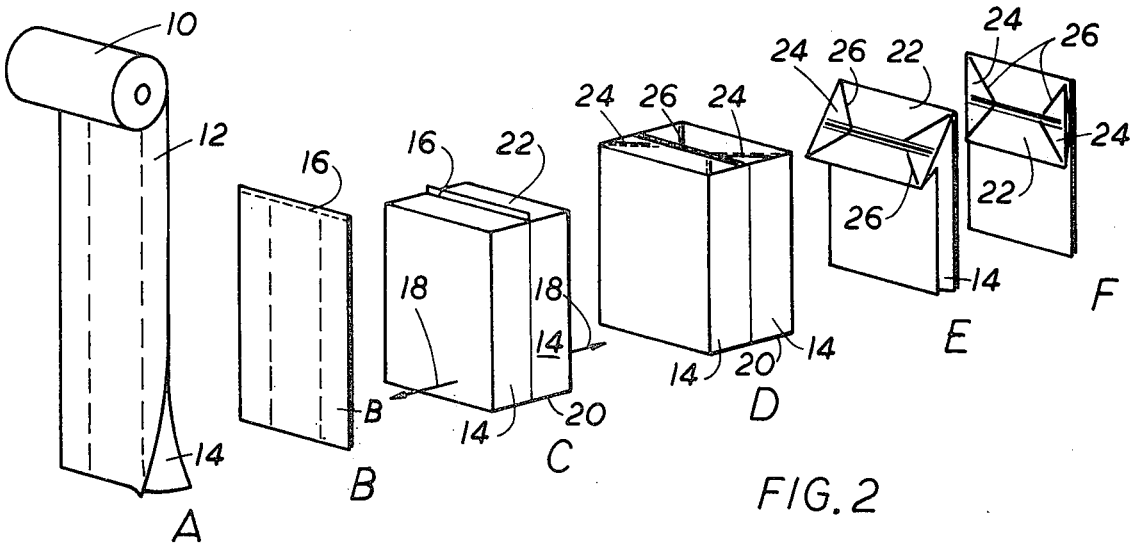
FIG. 2

APPARATUS FOR FORMING FLAT BOTTOM PLASTIC BAGS

This is a division of application Ser. No. 472,167 filed May 22, 1974, now U.S. Pat. No. 3,924,521.

BACKGROUND OF THE INVENTION

The present invention relates to a method and apparatus for making flat bottom plastic bags and in particular to a flat bottom bag having a bottom of more than one thickness and being reinforced.

In a co-pending application, Ser. No. 376,112, filed on July 3, 1973, now U.S. Pat. No. 3,916,770 there is disclosed a flat bottom bag formed of paper, plastic, cloth or combinations thereof in which a tubular length of material is first gusseted along two sides, cut into a predetermined length and provided with seal transverse to its length. Thereafter, a mandrel is inserted in the tube to shape the bag and flatten the bottom end into a reinforced multiple layer flat bottom. The present invention has as its main object the provision of an improved method for forming the bags disclosed in the aforementioned application and simple apparatus for carrying out the method in a continuous cyclical operation.

It is a further object of the present invention to provide a method and apparatus particularly adapted to the formation of thin walled plastic bags having flat bottom. In general, in the known prior art the formation of flat bottomed bags from thin walled plastic material was most difficult and virtually impossible wherein it was necessary to form the flat bottom with multiple reinforced layers sealed together to form the unitary structure. Substitute measures were only possible in the prior art. In particular, the prior art utilized separate reinforcing layers, such as heavy cardboard to maintain a flat rectangular bottom. More often than not, the flat bottomed construction required the creation of perforations or slits in order to create the necessary folds to establish the flat condition. The present invention has as its object the formation of an imperforate reinforced construction capable of carrying solids, granular and liquid materials. In general, the known apparatus for forming bags, particularly from plastic material, are complex and rather costly both to build and to operate, in addition to being incapable of making the flat bottom imperforate bag desired herein. It is accordingly another object of the present invention to provide simple economic apparatus for the formation of such bags.

The foregoing objects, as well as further objects, features and advantages of the present invention, will be more fully appreciated by reference to the following disclosure.

SUMMARY OF THE INVENTION

According to the present invention the method for forming a flat bottom reinforced bag comprises sealing one end of a tubular sleeve which has been previously folded to have opposed faces and sides gusseted inwardly between the opposed faces, pulling the opposed faces apart to open the sleeve and thereafter inserting a form within the sleeve. The form is pressed against the sealed end to flatten the gusseted sides forming flaps having folds with the opposed faces and the gusseted sides lying in overlapping relationship. Thereafter preselected portions of the flaps and the overlying sides and faces are joined together to form a flat bottom.

Preferably, the faces of the sleeve are pulled apart by exerting suction on their exterior surfaces, the suction being maintained until the form is capable of moving into and out of the open sleeve.

Preferably, the sleeve is cut from an endless tube of material which has been prefolded with its gusseted sides. The cutting of the sleeve and the seaming of its one edge can preferably be done simultaneously by combination knife and seal means. The form inserted within the open sleeve is also preferably provided with sealing means so that the gusseted flaps can be secured to the faces of the sleeve so as to form and maintain a flat bottom.

In carrying out the method the present invention provides novel apparatus for forming the reinforced flat bottom bags from a tubular sleeve having opposed faces and gusseted sides. The apparatus comprises means for supporting the sleeve adjacent one end, a foraminous plenum chamber located adjacent each of the faces of the sleeve having means for moving the chamber toward and away from the respective faces. Means are provided for seaming closed one end of the sleeve to seal the opposed faces together with the gusseted sides therebetween. The plenum chambers are movable inwardly relative to each other to engage the respective faces of the sleeve to support the sleeve during the seaming operation and is movable outwardly thereafter. Means are provided for applying a vacuum through the plenum chambers on the outward movement so as to cause the faces of the sleeve to adhere to them and open the sleeve. A mandrel is movable into the open end of the sleeve against the seamed end to flatten the gusseted sides forming flaps having folds with the opposed faces in overlying relationship. Means are provided for securing the flaps and the overlying sides along preselected lines thereby forming and maintaining a flat bottom.

The apparatus includes means for supporting a substantially endless reel of plastic material which is prefolded with its opposing faces and gusseted sides into a continuous sheet. The apparatus includes means for withdrawing a predetermined length of sleeve from the sheet and cutting the length therefrom. Preferably the means for withdrawing the sheet comprises a pair of engaging pull rollers which are intermittently driven so as to obtain predetermined lengths. The pull rollers are arranged to support the sheet in a vertical plane and the foraminous plenum chambers are arranged parallel to the plane and movable in a direction transversely thereto. The cutting means and the means for forming the seam in the sleeve are preferably mounted on a common support and operable simultaneously. Accordingly, the foraminous plenum chambers are movable into engagement with the faces of the sheet prior to the cutting of the sheet from the reel.

A plate is provided which is movable over the exterior surface of the seamed end of the sleeve which acts in cooperation with a mandrel to press the seamed end flat against the bottom and to act as a counter for the mandrel. If desired a flow of air may be impressed into the open end of the sleeve on the outward movement of the foraminous plenum chambers to assist in the opening of the sleeve. Further, a flow of air under pressure may be impressed outwardly from the foraminous plenum chambers on withdrawal of the predetermined length of the sleeve from the reel. This flow of air insures the free movement of the sheet material and prevents any harmful effects arising from static electricity.

The apparatus is further provided with means for collapsing the formed bag so that it again assumes its flat position in which the gusseted folds extend inwardly. The apparatus also includes means for folding the bottom flat against one of the faces of the sleeve. This latter folding means also comprises the means for removing and ejecting the completed bag from the apparatus.

Full details of the present invention are set forth in the following description and are illustrated in the accompanying drawings.

BRIEF DESCRIPTION OF THE DRAWINGS

In the drawings:

FIG. 2 is a series of views A through F showing various stages of bag formation according to the method of the present invention, FIG. 4 is a sectional view of the apparatus taken along line 4—4 of FIG. 3A, FIG. 5 is a sectional view of the apparatus taken along FIG. 5—5 of FIG. 3A.

DESCRIPTION OF THE INVENTION

Figure 1:
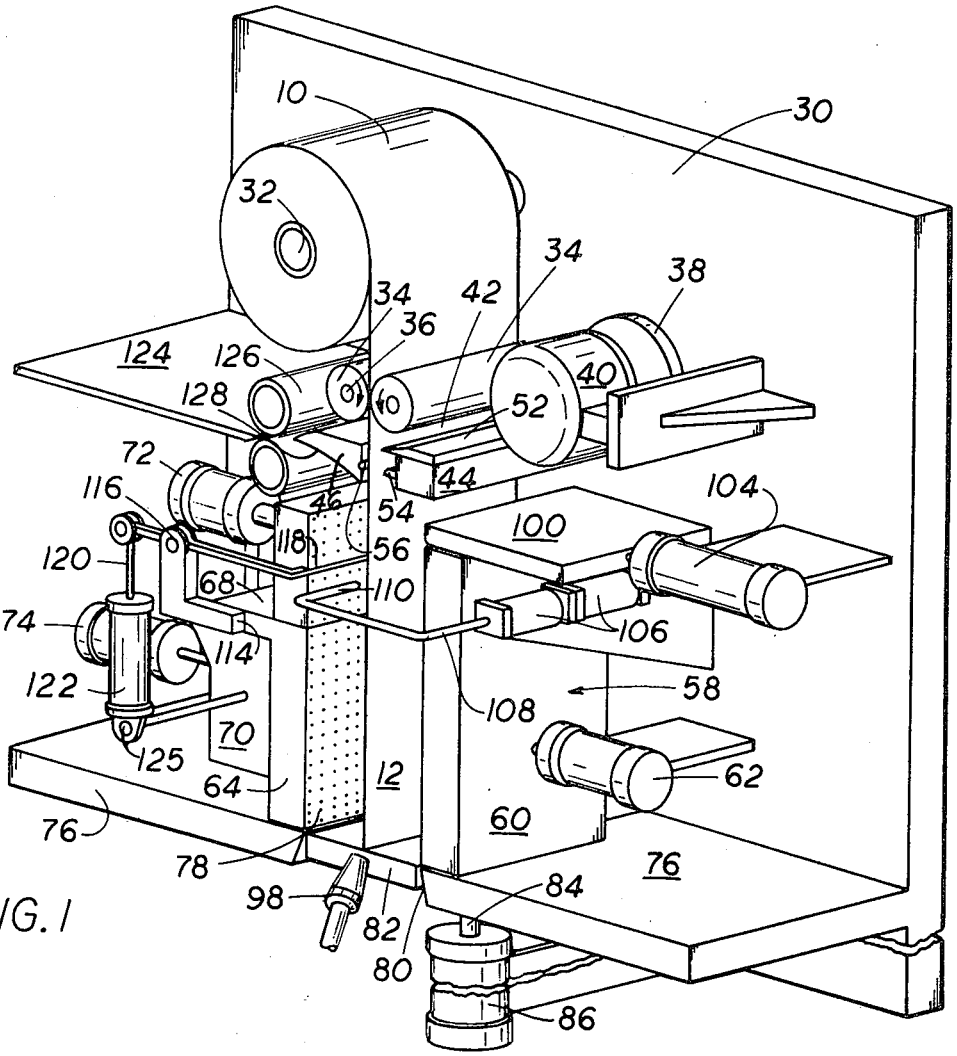
FIG. 1 is an isometric view of the apparatus for carrying out the present invention.

The formation of flat bottom bags according to the present invention is concisely illustrated in the sequential views shown in FIG. 2. Initially a reel 10 of unseamed or seamed flattened tubing 12, preferably of plastic, but of any other applicable material, prefolded with longitudinal gusset folds 14 is provided. In the first stage (FIG. 2A) a predetermined length of flat tubing 12 sufficient to form a bag B is withdrawn from the reel 10. In the second stage a transverse seam 16, preferably heat sealed, may also be formed by other methods, as glueing. The seam 16 is formed at what becomes the bottom edge of the bag and the predetermined length of tubing is cut adjacent the seam so as to separate that portion from the endless reel.

In the third stage (FIG. 2C), the sides of the flat tubing 12 are pulled outwardly in the direction of arrows 18 causing the bag to open and expose the gusset sides. A forming mandrel is then inserted through the open end 20 of the bag B until a flat bottom 22 is formed. During this stage, the gusset portions adjacent and held by the bottom seam 16 are folded into triangular flaps in the interior of the bag. In the fourth stage (FIG. 2D), the flaps 24 are heat sealed along lines 26 to the exterior tubing material so that they become integrally formed with the bottom 22 of the bag. Thereafter the mandrel is withdrawn. In the fifth stage (FIG. 2E), one side of the bag is pushed inwardly, as the mandrel is being withdrawn, this folds the bottom of the bag 22 toward one of its sides simultaneously the gusset folds 14 are again folded inwardly. In the final stage (FIG. 2F), the bag bottom 22 is pressed against the bag sides and moved to a storage in stacking position.

As seen in FIG. 1, the apparatus for carrying out the aforementioned method comprises a supporting frame having a back wall 30 on which is journaled a freely rotatable supporting shaft 32 extending cantilevered from the back wall in a horizontal plane. The reel 10 of plastic tubing 12 is adapted to be held on the shaft 32 and to be passed downwardly between a pair of contra-rotating pull rollers 34 located below and somewhat to the side of the shaft 32. The pull rollers 34, preferably made of rubber or other similarly resilient material are in pressure engagement with each other and as seen in FIG. 4 are each mounted on shafts 36 journaled in the back wall 30. The rollers 34 are interconnected for conjoint rotation by an intermeshing gear train 38 to a drive motor 40 also mounted on the back wall. The motor 40 is connected to an automatic control system (not shown) so that it may be intermittently driven in accordance with the predetermined program to withdraw a predetermined length of tubing 12 from the reel 10 and allow the tubing to hang vertically therefrom.

Located a short distance below the drive rollers 34 is a sealing and shearing assembly, generally depicted by the numeral 42. This assembly comprises cooperating right and left hand bars 44 and 46 respectively, mounted in a guide rail support 48 on the back wall so as to be reciprocatingly movable toward and away from each other in a horizontal plane normal to the vertical plane defined by the hanging plastic tubing 12. The bars 44 and 46 are connected by a suitable gearing or rack mechanism with a linear motor 50, as seen in FIG. 5 so that they are simultaneously moved. Fixed to the guide rail is a stop block 51 which may be used to limit the movement of the bars 44 and 46 toward each other. Fixed to the upper edge of the right bar 44 is a knife 52, the cutting edge of which is adapted to slidingly engage the upper surface of the left bar 46, which thus serves as a knife counter therefor. The right bar 44 is further provided with an elongated linear heating element 54, suitably connected to a source of current, while the left bar 46 is provided with a groove 56 adapted to receive the heating element 54.

Figure 7:
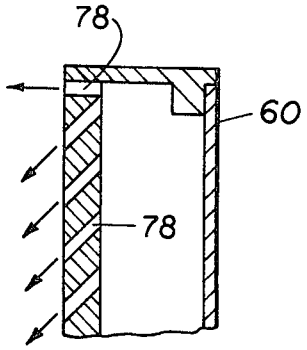
FIG. 7 is an enlarged portion of the plenum chamber of the apparatus showing the direction of its air holes.

Located below the sealing and shearing assembly 42 is a tube distension assembly, generally depicted by the numeral 58, comprising a vertically disposed first hollow plenum chamber box 60, movable toward and away from the plane of the depending plastic tube 12, by a linear motor 62 secured to its back wall face and mounted on the back wall of the machine frame. On the left side of the plastic tube 12 a second and third hollow plenum chamber box 64 and 66 are located vertically one above the other. The lower left plenum box 64 is provided with a horizontal shelf 68 formed above a rearwardly extending base web 70 on which the upper left plenum box 66 slidably rests. The upper plenum box 66 is movable toward and away from the plane of the plastic tubing 12 by a linear motor 72 which is secured to its rear face and is mounted on the base web 70. Similarly the lower plenum box 64 is movable in the same direction by attachment with another linear motor 74 which is itself mounted on the back wall 30 of the machine frame. The vertical height of both the lower left plenum chamber and the upper left plenum chamber 64 and 66 respectively is equal to that of the right plenum chamber 60 and because motor 72 actuating the upper left plenum box 66 is secured to the base 70, the upper plenum box 66 can be made to be conjointly movable toward and away from the plane of the plastic tubing 12 together with the lower plenum box, by not actuating the motor 72. On the other hand relative movement between the upper plenum box 66 and the lower plenum box 64 is possible by independently activating the motor 72. Actuation of the motor 74 causes both the lower plenum box 64 and the upper plenum box 66 to move toward and away from the plane of the plastic tubing 12. The upper plenum box 66 and the lower left plenum box 64 both slidably rest on a horizontal supporting plate 76 which extends perpendicularly outward from the back wall 30 of the machine frame. Each of the plenum boxes 60, 64 and 66 are provided with a front wall having a plurality of holes 78 and each are connected to a source of both air under pressure and under vacuum. The source may be a common source and in any event the sources are provided with suitable control valving for regulating intermittent flow of either air or vacuum inwardly or out of the plenum boxes 60, 64 and 66. As seen in FIG. 7, the major portion of the holes 78 are angled downwardly toward the plane of the depending plastic tubing 12 while at least some of the holes along the upper edge of the right plenum box 60 and the upper left plenum box 66 are horizontally directed.

Figure 10:
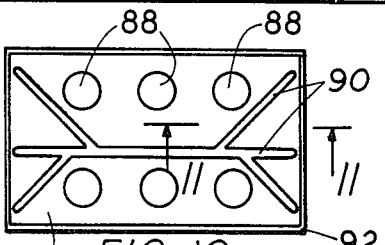
FIG. 10 is a top view of the forming mandrel showing the heat seal means, the forming lip and ventilation holes.
Figure 9:
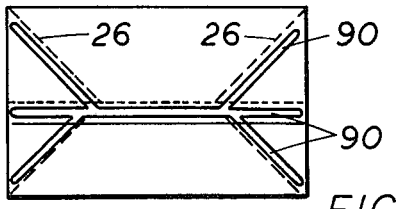
FIG. 9 is an external view of the bag bottom as seen in FIG. 8 showing the position of the heat sealing means.
Figure 11:
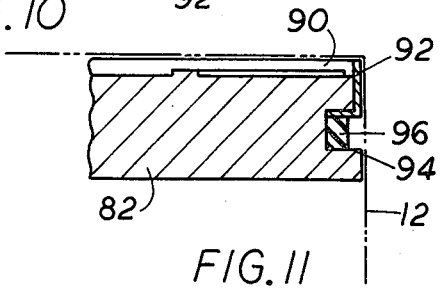
FIG. 11 is a sectional view taken along lines 11—11 of FIG. 10.

The horizontal plate 76 is divided symmetrical to the plane of the vertically depending plastic tube 12 to provide a slot 80 in which is located a forming mandrel 82. The mandrel 82 comprises a flat horizontal plate-like member fixed at the end of a rod 84, connected to a linear motor 86 adapted to move the mandrel vertically from the slot 80 upwardly toward the sealing and shearing assembly. As seen in FIG. 10, the forming mandrel 82 is provided with a plurality of ventilation holes 88 and electric heater or glueing bars 90 arranged in a configuration conforming to the manner in which the gusset flaps 24 are to be sealed as disclosed in the co-pending application. The forming mandrel 82, as seen further in FIG. 11, is provided with a peripheral lip member 92 comprising a rectangular frame having an L-shaped cross section. The base leg of the lip 92 is set within a circumferential slot 94 and held therein by a flexible or resilient member 96 such as a rubber pad so that under upward movement of the forming mandrel 82, the lip 92 can engage the inner surface of the plastic tubing causing the same to open into the relatively flat shape of the bag bottom 22 seen in FIG. 2D having accurately folded corners and edges. The resilience of the lip 92 allows the lip to recede under pressure thus ensuring that the plastic tubing will not be torn.

Figure 6:
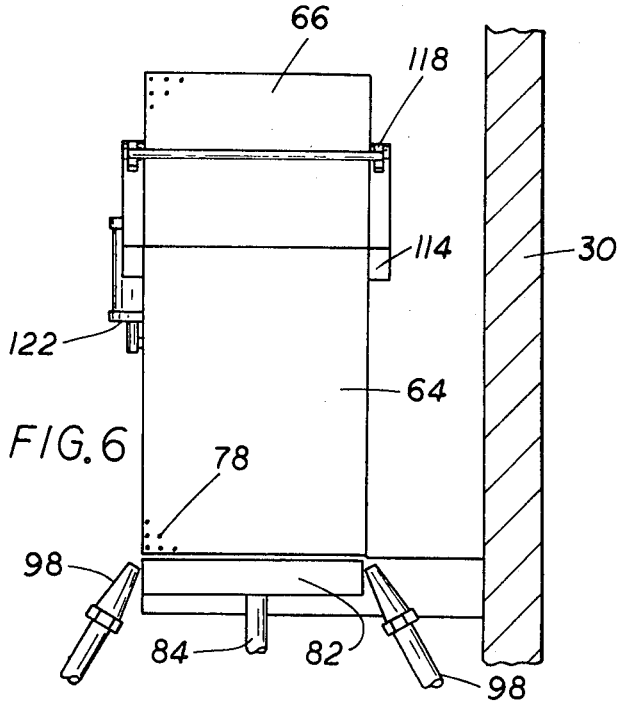
FIG. 6 is a sectional view of the apparatus taken along line 6—6 of FIG. 3A.

Located at the level of the horizontal plate 76, along the vertical plane of the depending plastic tubing 12, are a pair of air jet nozzles 98, one on each of the forward and rear sides of the forming mandrel 82, as seen in FIG. 6. The air jet nozzles 98 are connected to a source of air under pressure with suitable regulating and controlling mechanisms to provide intermittent blast of air on predetermined signal.

Mounted above the right plenum box 60 in a horizontal plane is a press plate 100 secured to the end of a rod 102 activated by a linear motor 104. The press plate is adapted to slidably rest on the upper edge of the plenum box 60 and to be movable transversely across its top toward the left side of the apparatus to a position directly in line with the forming mandrel 82.

Figure 12:
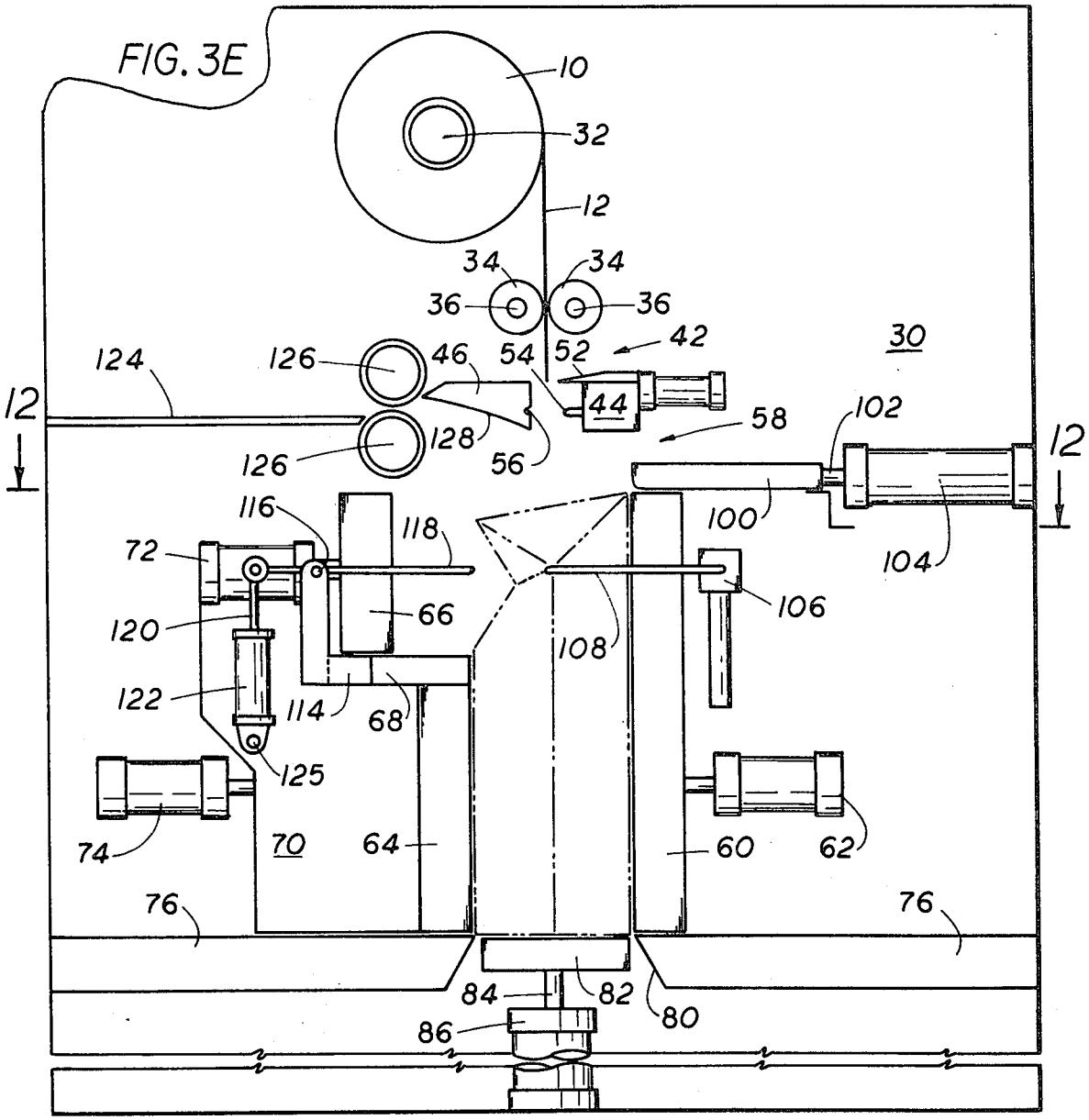
FIG. 12 is a sectional view of the apparatus taken along line 12—12 of FIG. 3E.
Figure 12:
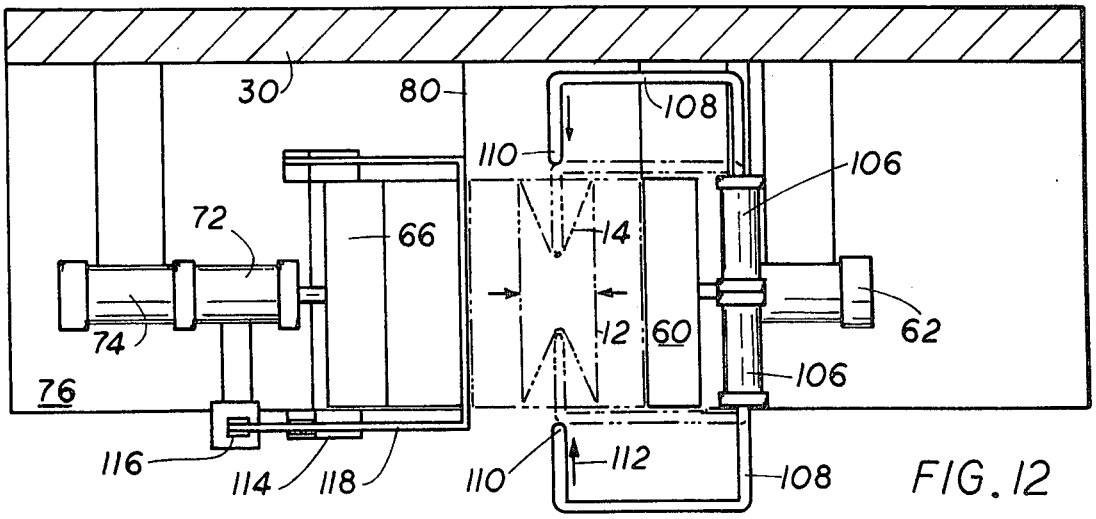

Mounted to the back wall 30 behind the right plenum box 60 are a pair of back to back linear motors 106 adapted to move in a direction parallel to the plane of the depending plastic tubing 12 and perpendicular to the plane of the back wall 30. Extending from each of the linear motors 106 is a wire rod 108 in the form of a U-shape. The U-shaped wire rods 108 bend around the right plenum box 60 each terminating in a tuck finger 110 extending in the plane of the depending plastic tubing 12. The motors 106 are adapted to move the tuck fingers 110 inwardly in the direction of arrow 112, as seen in FIG. 12, along the plane of the plastic tubing to engage with the gusset folds 14.

Fixed to each side edge of the shelf 68 of the lower left plenum box 64, are a pair of L-shaped brackets 114 having one leg extending vertically upward. Attached to pivot about a point 116 on the upper ends of the vertical legs is a U-shaped wire ejection bar 118 which girdles the upper plenum box 66. The ejection bar extends rearwardly from the pivot point 116 and is connected to a rod 120 extending from the vertically movable linear motor 122 pivotally mounted on the base web 70 of the lower left plenum box 64. The wire ejection bar extends forwardly of the pivot point 116 to the plane of the front face of the lower plenum 64 with which it is conjointly movable in the horizontal direction by virtue of its connection to the base web 70. The upper left plenum box 66 is provided with a groove 123 into which the wire ejection bar 118 may recede when the upper plenum box 66 is aligned with the lower plenum bar 64, as seen in FIG. 1, on withdrawal of the upper plenum box 66 rearwardly from the plane of the lower left plenum box 64, the ejection bar is free to pivot and on actuation of the motor 122 is caused to pivot in the direction of the arrow as seen in FIGS. 3G and 3H.

Located above the upper left plenum 66 and slightly to the left is a take off platform for the finished bag. The platform comprises a flat plate 124 at the leading end of which are located a pair of ejection rollers 126, having a rubber or resilient plastic face in pressure contact with each other. The platform plate 124 and the nip of the rollers 126 lie in a horizontal plane substantially even with the lower surface 128 of the counter sealing and shearing bar 46, which lower surface is curved to permit a smooth arcuate extension from substantially the vertical plane of the plastic tubing 12 to the plane of the platform plate 124. The several linear motors which are shown preferably comprise air piston and cylinder actuators of conventional form. Hydraulic piston and cylinder actuators may also be used as can rotary electric motors coupled with suitable pinion and rack means. Solenoid actuated pistons may also be used. The structure and operation as well as the use of these devices as well as other equivalent devices will be obvious to those skilled in the present art. A source of air both under pressure and under vacuum is required in the present apparatus. Suitable pump compressor or similar means may be provided to supply either or both. Conventional control means, valve means, etc. to regulate the operation of the air supply will also be obvious. For clarity and simplicity some of the parts of the present apparatus have been omitted from the drawings, tubular connectors, electrical connectors, vacuum fittings, etc. have all been omitted from the drawings and from the description. While specific details such as these are not shown their structure and function will be obvious. Suitable interlocks and control means as well as a programable control system obtaining sequential operation of the various elements of the present apparatus are also omitted for the sake of clarity and brevity. The following description of the apparatus through its sequential steps and operation cycle to form a bag will render the further description of the omitted elements unnecessary. In the following description of the apparatus it will be clear that the positions shown in FIGS. 3A through 3E correspond to the method steps 2A through 2E respectively while the positions shown in FIGS. 3F through 3G correspond in total to the steps shown in the method stage illustrated in FIG. 2F.

The various control and interlock system will be apparent from the following description.

Turning now to FIG. 3A, the operation of the apparatus is initiated by placing the supply reel 10 on the supporting shaft 32 and extending its leading edge between the pull rollers 34 simultaneously the bars 44 and 46 of the sealing and shearing assembly, the plate 100, the right plenum chamber 60 and the left plenum chambers 64 and 66 jointly are withdrawn to their furthest position from the plane of the plastic tubing 12. Simultaneously the forming mandrel 82 is retracted to its lowest position. This leaves a free path of movement along the vertical plane for the tubing 12. In the first stage of operation the pull rollers 34 are actuated by their motor 40 so as to withdraw a predetermined length of tubing 12 from the reel 10. This is obtained by programming the length of time the motor 40 is actuated for a predetermined time dependent upon the diameter of the rollers 34 thereby a given length can be obtained. If desired, suitable sensing means such as a photoelectric cell, microswitch or the like can be arranged along a path of the plastic tubing 12 to determine the length withdrawn. To assist the tubing 12 as it is being withdrawn from the reel 10 and to prevent static electricity from causing the tubing to be attracted to either one or the other of the plenum boxes, a flow of air under pressure is supplied to the plenum boxes 60, 64 and 66 under low pressure so that the air streams outwardly from the plenum boxes in the direction of the arrows shown in FIG. 1. The flowing outward air insures that the plastic tubing will descend along the central plane and without creases or folds.

Figure 3C:
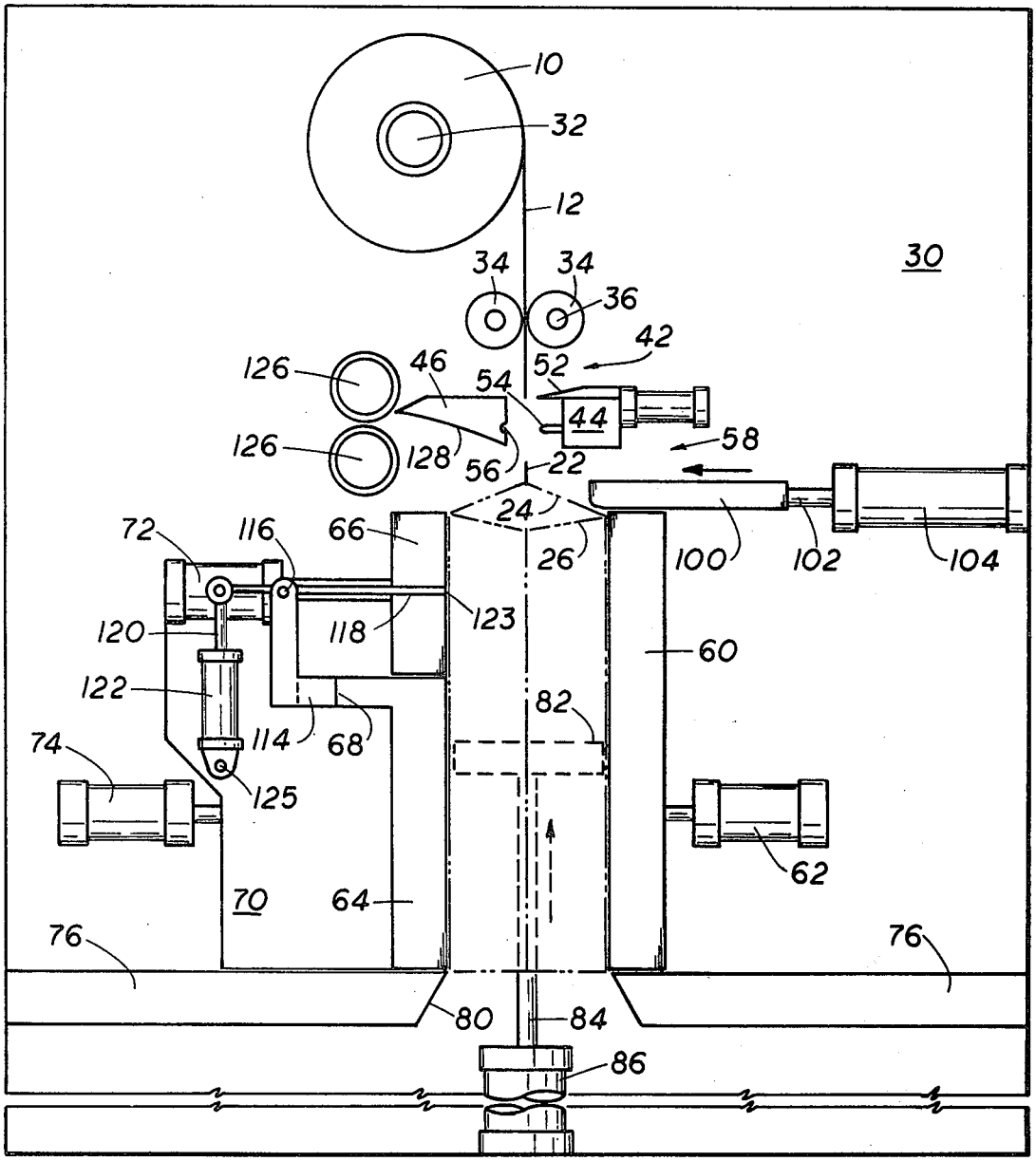
FIGS. 3A through 3E are front elevational views of the apparatus shown in FIG. 1 showing sequentially the operation of the apparatus through the respective stages of bag formation corresponding to FIGS. 2A through 2E, FIGS. 3F through 3H show sequentially the several steps in the final stage of the method of bag formation corresponding to FIG. 2F.

After the predetermined length of plastic tubing 12 is withdrawn by the pull rollers 34 the pull rollers stop and thereafter the plenum boxes 60, 64 and 66 simultaneously are moved inwardly toward the plastic tubing 12 as indicated in FIG. 3B until they abut the surface of a plastic tubing. The plastic tubing is then held taut between the arrested drive rollers 34 and the plenum boxes. Almost simultaneously the sealing and shearing assembly bars 44 and 46 are caused to move inwardly toward each other. The knife 50 cuts the tubing transversely to the vertical plane while simultaneously the heater element 54 heat seals the bottom edge with the seam 16 as seen in FIG. 2B. During this operation both the forming mandrel 82 and the plate 100 remain in their retracted positions. After the creation of the heat sealed seam 16 the bars 44 and 46 of the sealing and shearing assembly together with the right plenum box 60 and the jointly aligned plenum boxes 64 and 66 begin a rearward or outward movement from the plane of the plastic tubing 12; as soon as this outward movement begins a vacuum is applied in each of the plenum boxes causing the flat sides of the plastic tubing to adhere to their faces. Simultaneously air under pressure is applied through the air jet nozzles 98 located at the level of the horizontal shelf 76. This causes an air flow into the open end of the tubing assisting in the opening of the tubing into the form shown in FIG. 3C. As the plenum boxes pull the sides of the plastic tube the sealed upper end, which now is to become the bottom of the bag, is pulled downwardly, the gusset folds are pulled outwardly and the bottom edge opened. As soon as the bottom edge opens, the forming mandrel 82 is elevated by its motor 86 into the bag, as seen in FIG. 3C. Simultaneously the plate 100 is advanced across the upper edge of the plenum box 60 by its motor 104. As the plate 100 advances, it wipes across the exterior surface of the bottom of the bag folding and flattening down the transverse excess tab remaining between the seam 16 and the edge at which it was sheared from the remaining tubing on the reel 10 to form a perfectly flat bottom as seen in FIG. 8.

The forming mandrel 82 rises and the plate 100 advances simultaneous to each other until the forming mandrel causes the interior of the bag to be wedged between it and the plate 100 as seen in FIG. 3D. In this position, the forming lip 92 resiliently creases the corner and bottom edges of the bag to form a perfectly flat bottom. Whereupon the heating or glueing elements 90 located on the forming mandrel heat seals or glues the gusset flaps and the bottom seam in the form indicated in FIG. 2D. The location of the ventilation holes 88 in the forming mandrel 82 enable the movement of the mandrel through the bag and the escape of both heat from the sealing element 90 as well as of air from within the bag. The continued application of suction through the plenum boxes 60, 64 and 66 and the introduction of air under pressure through the nozzles 98 insure that the bag remains open during the formation of the bottom, the sealing process and the subsequent withdrawal of the mandrel.

Figure 8:
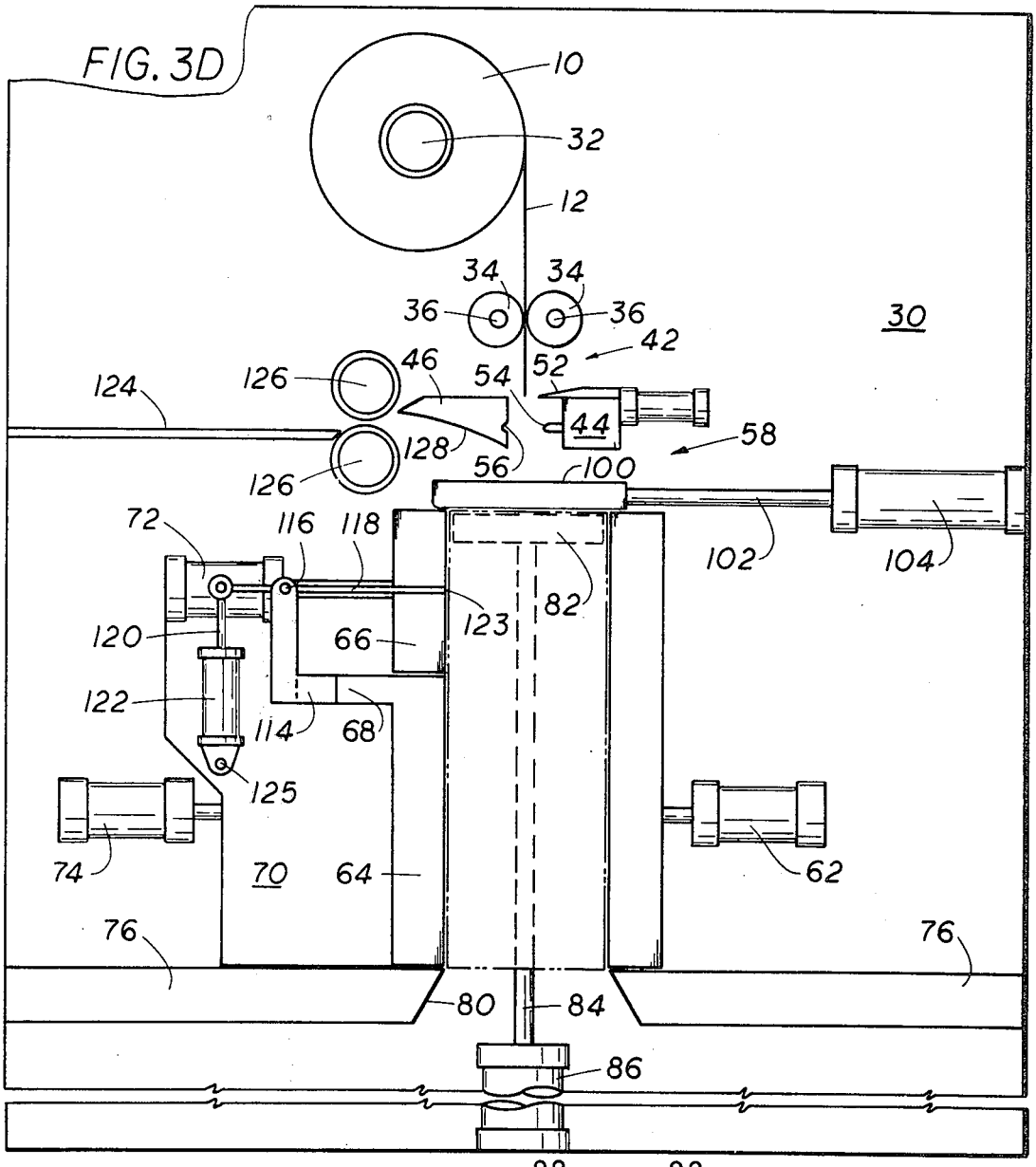
FIG. 8 is an exterior view of the bag bottom before being sealed and at the stage corresponding to FIG. 2C.
Figure 8:
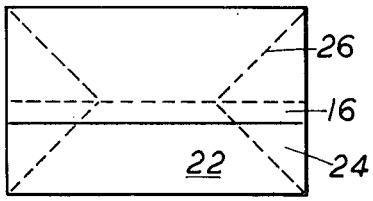

It will be observed from FIGS. 3C and 3D that the opening of the bag and the insertion of the mandrel causes those portions of the gusset folds which had been adhered to the bottom seam 16 to fold into the triangular flaps 24 as seen in FIG. 8 and that once these flaps are sealed a substantially unitary reinforced bottom panel 22 is provided. This arrangement occurs without the necessity of supplying complex mechanisms for tucking and folding the flaps per se, the same being automatically produced merely upon the distension of the tube 12.

Figure 3F:
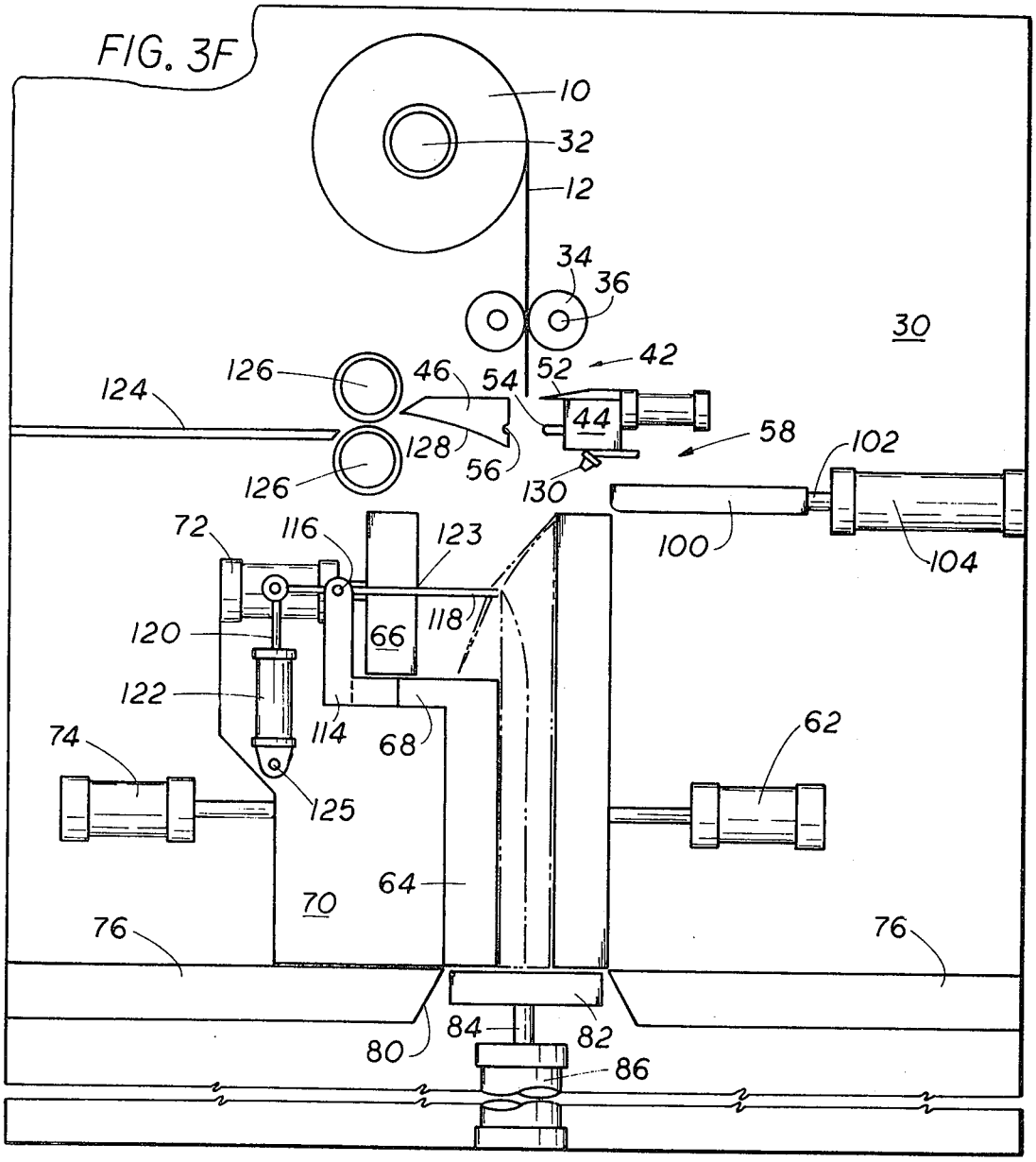
Figure 3G:
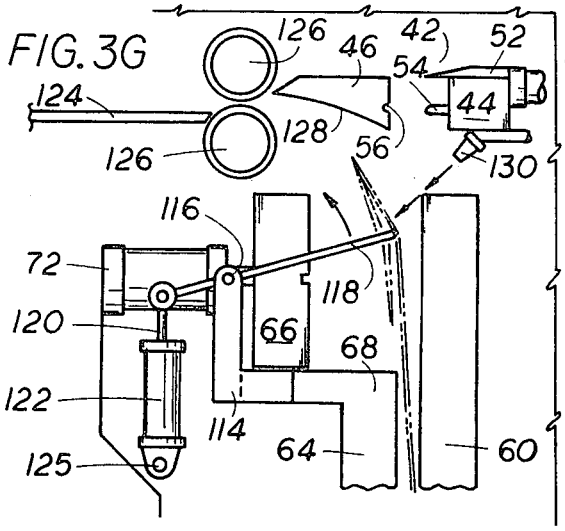
Figure 3H:
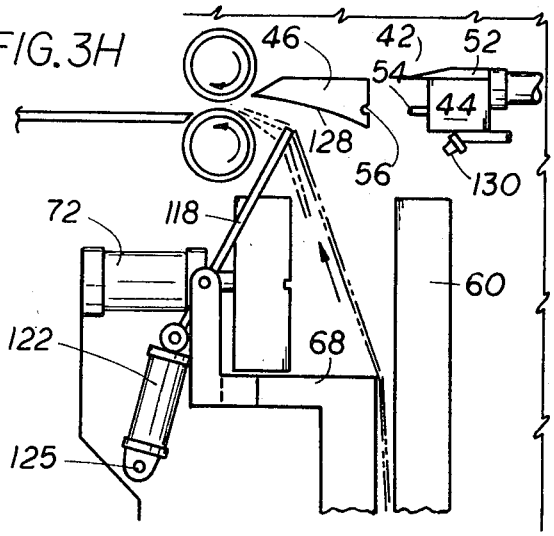

As seen in FIG. 3E, after the bottom panel is completed, the forming mandrel 82 is withdrawn and the plate 100 retracted. Suction however is maintained on the sides of the bag. Immediately following the withdrawal of the mandrel 82, the tuck fingers 110 are caused to move inwardly against the gusset fold 14, as seen in the dotted lines of FIG. 12. Simultaneously the upper left plenum box 66 is retracted outwardly from alignment with the lower left plenum box 64 leaving the bottom portion of the left side of the bag free. The introduction of the tuck fingers 112 thus causes the bag to fold inwardly along its gusset folds and to pivot inwardly along the bottom portion. As soon as this tip in occurs the right plenum box 60 and the lower left plenum box 64 are advanced inwardly toward the center line defined by the plane of the tubing 12 causing the flap sides of the bag to again collapse inwardly. As the lower left plenum box moves inwardly it carries with it the ejection bar 118 as seen in FIG. 3F, along the fold line established by the tuck fingers 110. The simultaneous inward movement of the plenum boxes causes the tube to again collapse into its flat state, the reinforced bottom 22 collapsing in a flat manner over the ejection bar 118. The upper left plenum box 66 is maintained in its rearmost position leaving a substantial amount of space free for the collapse and movement of the bottom panel 22. The plenum boxes 60 and 64 move inwardly until the completed bag is substantially collapsed into a flat condition and the bottom panel 22 is folded over vertically. Prior to this point the tuck fingers 110 are withdrawn so that it does not interfere with the collapse of the bag. Once the bag is collapsed, as seen in FIG. 3H, the ejector bar 118 is pivoted upwardly in the direction of the ejecting rollers 126 by activating the motor 122 to pull the rod 120 inwardly or downwardly. The motor 122 is pivoted about the extending shaft 125 so that in its downward movement it causes the ejecting bar 118 to move upwardly. As seen in FIG. 3H this pulls the completed bag upwardly with it until the leading edge of the bottom panel 22 engages between the ejecting rollers 126. The arcuate bottom surface of the counter bar 46 of the sealing and shearing assembly tends to direct the bag into the nip of the rollers 126 from whence the rollers will pull the bag outwardly and deposit it upon the take off platform 124. To prevent the bag from sticking to the faces of the plenum boxes, a low pressure supply of air is fed to the plenum boxes. To further assist in the direction of the bag as it is being ejected by the ejector bar 118 and to insure that the bottom panel 22 remains hooked over the ejector bar 118 during its upward travel, a air jet nozzle 130 as seen in FIGS. 3F and 3G can be supplied in order to direct a blast of air on the opposite surface of the bag. The bag formation cycle is completed once the bag is deposited on the platform 124 whereupon the components take their initial positions as seen in FIGS. 1 and 3A, that is the ejector bar 118 moves down into its horizontal position and the upper left plenum box moves forwardly into alignment with the lower left plenum box 64. The cycle may thereupon be restarted.

It will be seen from the foregoing that a substantially simple method and rather simple apparatus is provided for the formation of flat bottomed plastic bags. The present apparatus and method is particularly suitable for use with plastic raw material since the same can be supplied in substantially endless webs facilitating its cyclic handling. Furthermore, the use of vacuum and air enables the handling by rather simple apparatus of thin highly flexible plastic sheet material. In particular, the method and apparatus provides simple means for forming a perfectly flat bottomed bag in which the bottom is formed with a single operation.

Various modifications and changes have been suggested in the disclosure, others will be obvious to those skilled in the present art. It is therefore intended that the present disclosure be taken as illustrative only of the invention and not limiting thereof.

Although throughout the disclosure the sealing or glueing elements 90 have been related to the mandrel operating in cooperation with the presser plate 100, those skilled in the art will readily recognize that the functions may be changed by simple rearrangement of structures. Thus, it is within the scope of the invention to provide that one or more or all of the elements 90 may be on the plate 100 or that both the plate 100 and the mandrel 82 may include such elements in facing cooperating relationship. When the elements 90 are employed for glueing, conventional glue conduits and valves will be substituted for the electrical lines and switches without departing from the inventive disclosure.

We claim:

1. Apparatus for forming reinforced flat bottom bags from a tubular sleeve having opposed faces and gusseted sides, comprising means for supporting said sleeve, a plurality of foraminous plenum chambers, one of said chambers located adjacent each of the faces of said sleeve, means for moving said plenum chambers toward and away from each other to engage the respective faces of said sleeve and thereafter movable outwardly, means for seaming closed one end of said sleeve to seal said opposed faces together with the gusseted sides therebetween, means for applying a vacuum through said plenum chambers on the outward movement thereof to cause the faces of said sleeve to adhere thereto and to open said sleeve, means for cutting said sleeve into individual bag sleeves before said bag sleeves are opened, a mandrel movable into the other end of each said bag sleeve to press against the seamed end flattening the gusseted sides and forming flaps having folds with the opposed faces in overlying relationship, and means for securing selected portions of said flaps and said overlying sides and faces to form a reinforced bottom.

2. The apparatus according to claim 1 wherein said mandrel has a rectangular face conforming to the cross section of said bag sleeve and is provided with the means for securing the flaps overlying the sides and faces in said rectangular configuration forming a flat bottom.

3. The apparatus according to claim 2 wherein said bag sleeve is formed of plastic material and said seams are formed by heat sealing.

4. The apparatus according to claim 3 wherein said plastic material is supplied as a substantially endless reel prefolded with its opposing faces and gusseted sides into a continuous sheet, said apparatus including means for supporting said reel, withdrawing a predetermined length conforming to said bag sleeve from said reel.

5. The apparatus according to claim 1 including a plate movable over the exterior surface of the seamed end of said bag sleeve to cooperate with said mandrel to press said end into its bottom shape.

6. The apparatus according to claim 1 including means for impressing a flow of air into the other end of said bag sleeve on the outward movement of said foraminous chambers.

7. The apparatus according to claim 1 including means for collapsing said open bag sleeve after formation of the bottom comprising means for folding said gusseted sides inwardly and for folding said flat bottom against one face of said bag sleeve.

8. The apparatus according to claim 7 including means for removing the collapsed bag sleeve from between said foraminous chambers.

9. The apparatus according to claim 7 wherein said means for folding said gusseted sides comprises a pair of fingers movable into engagement with said sides until the same are folded and then retractable therefrom.

10. The apparatus according to claim 7 wherein said means for folding said bottom comprises a bar movable into engagement with one face of said bag sleeve below said bottom.

11. The apparatus according to claim 10 wherein said bar is spaced from the bottom of said bag sleeve to permit said bottom to fold thereover, said bar being pivotable upwardly between said bottom and the face of said bag sleeve to lift said bag sleeve from between said foraminous chambers.

12. The apparatus according to claim 11 wherein said bar is mounted in cooperation with one of said foraminous chambers, said foraminous chamber being formed in two parts, the part adjacent said bar being movable rearwardly from the face of said bag sleeve on the upward pivoting of said bar.

13. The apparatus according to claim 4 including means for impressing the flow of air under pressure outwardly of said foraminous chamber on withdrawal of said predetermined length of bag sleeve from said reel.

14. The apparatus according to claim 13 where said foraminous plate is formed with holes angled to the horizontal in the direction of movement of said withdrawn sleeve.

15. The apparatus according to claim 14 wherein the means for supporting said reel comprises a rotatable shaft and the means for withdrawing the predetermined length therefrom comprises a pair of engaging pull rollers extending parallel to said shaft and spaced from said shaft to receive the end of said continuous sheet and means for intermittently rotating said pull rollers to withdraw said predetermined length.

16. The apparatus according to claim 15 wherein said pull rollers are arranged to support said sheet in a vertical plane, said cutting means being arranged below said pull rollers, said foraminous chambers being arranged parallel to said plane and movable into engagement with the faces of said sheet prior to the cutting of said sleeve from said reel, to thereby support said sleeve.

17. The apparatus according to claim 16 wherein said cutting means and said means for forming said seam are mounted on a common support and operable simultaneously.

18. In an apparatus for forming a reinforced flat bottom plastic bag from a roll of plastic tubing having opposed faces and gussetted sides, means on said apparatus to support the roll of plastic tubing and means to dispense the same from said support means, means operable on said apparatus to engage the faces of the plastic tubing to seal the same together with the gussetted sides therebetween and to form the bag bottom at one end thereof and to sever a length of the sealed tubing from the roll thereof to form the bag length, means adjacent the length of the bag to cause the faces thereof to separate and to open the length of the bag after the bag length is severed, a mandrel movable into the open severed end of the bag and engaging the gussetted sides to press and flatten the same against the bag bottom thereby forming reinforcing flaps relative to the bag bottom and opposed faces sealed together.

19. In an apparatus as in claim 18, means cooperating with said mandrel when the same flattens the gussetted sides against the bag bottom to secure the reinforcing flaps to the related opposed faces.

20. In an apparatus as in claim 19, means operable on said apparatus to engage and collapse the bag at the gussetted sides thereof and to fold the bag bottom against one of the opposed faces.

* * * * *